US005520036A

United States Patent [19]

Collier

[11] Patent Number: 5,520,036

[45] **Date of Patent: *May 28, 1996**

[54] SEPARABLE KEYHOLDER WITH MULTIPLE KEYRINGS

[75] Inventor: Michael R. Collier, Denver, Colo.

[73] Assignee: Harmony Fastening Systems, Inc., Denver, Colo.

[ * ] Notice: The term of this patent shall not extend beyond the expiration date of Pat. No. 5,261,257.

[21] Appl. No.: 152,984

[22] Filed: Nov. 15, 1993

Related U.S. Application Data

[63] Continuation-in-part of Ser. No. 828,242, Jan. 30, 1992, Pat. No. 5,261,257.

[51] Int. Cl.[6] ..... A44B 15/00

[52] U.S. Cl. ..... 70/456 R; 24/575; 70/459

[58] Field of Search ..... 70/456 R, 456 B, 70/457, 458, 459; 206/37.1, 37.2–37.8, 38.1; 24/3 K, 575, 577, 579.1; D3/207–212

[56] References Cited

U.S. PATENT DOCUMENTS

| | | | |
|---|---|---|---|
| 2,482,422 | 9/1949 | Loew | 70/456 R |
| 2,672,044 | 3/1954 | Martin | 70/456 R |
| 4,248,071 | 2/1981 | Kussoy | 70/459 |
| 4,999,885 | 3/1991 | Lee | 24/575 |
| 5,069,050 | 12/1991 | Chen | 70/456 R |
| 5,106,252 | 4/1992 | Shapton | 411/539 |
| 5,261,257 | 11/1993 | Collier | 70/459 |
| 5,339,664 | 8/1994 | Mellor | 70/456 R |

FOREIGN PATENT DOCUMENTS

| | | | |
|---|---|---|---|
| 2093340 | 9/1982 | United Kingdom | 70/456 R |

*Primary Examiner*—Darnell M. Boucher
*Attorney, Agent, or Firm*—Kenton L. Freudenberg; Maxwell C. Freudenberg

[57] ABSTRACT

A group of several identical interconnected but separable key ring support members arranged as a composite structure. Each of the support members has a respective attached key ring. Each support member has two separate attachment parts at different locations on said member for directly connecting it to one or more members of said group by manually pressing the several members together. Manually releasable interlocking attachment parts enable one or more of the key ring support members to be selectively separated from the composite structure.

25 Claims, 13 Drawing Sheets

Fig. 1
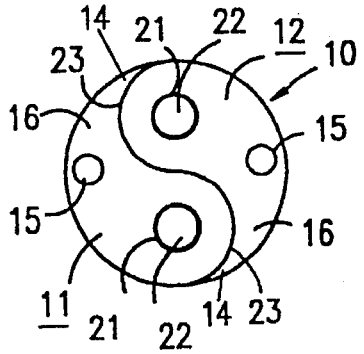
Fig. 2
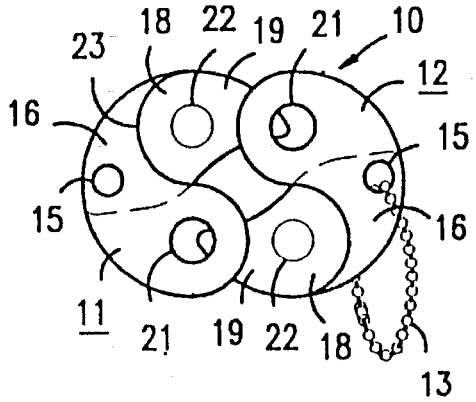
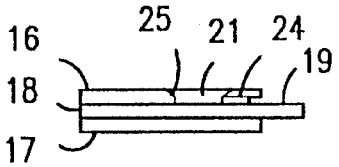
Fig. 3
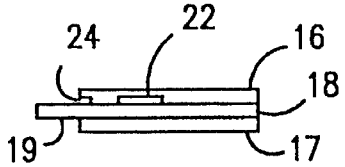
Fig. 4
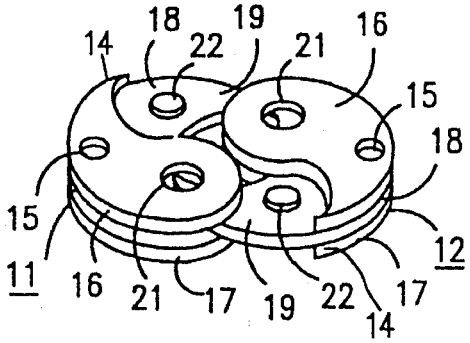
Fig. 5
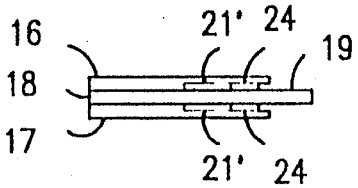
Fig. 7
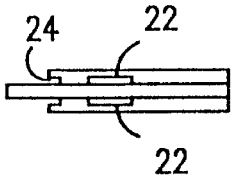
Fig. 8
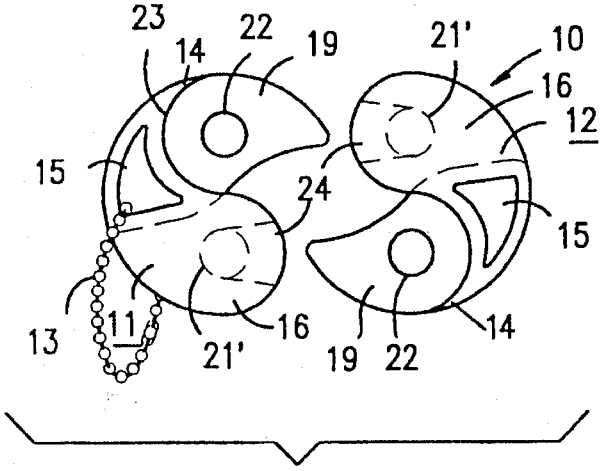
Fig. 6

Fig. 9
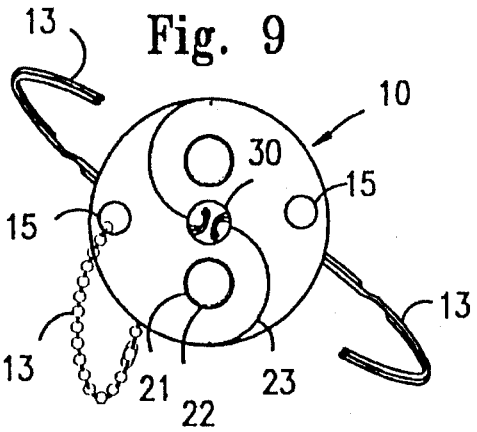
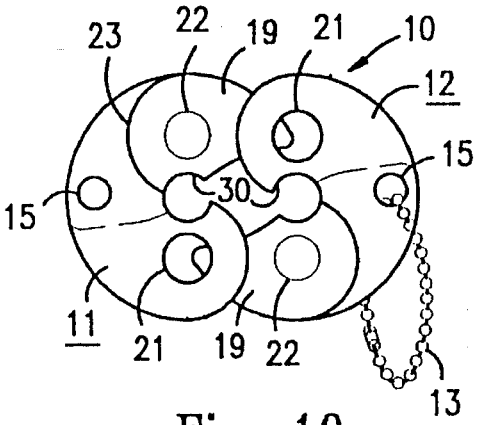
Fig. 10
Fig. 11
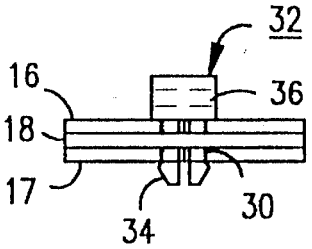
Fig. 12
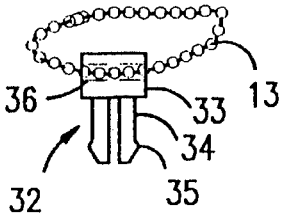
Fig. 15
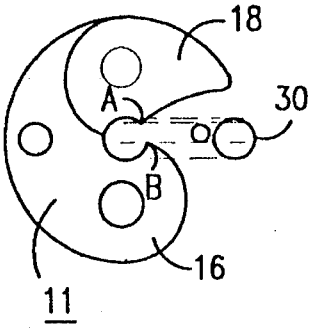
Fig. 13
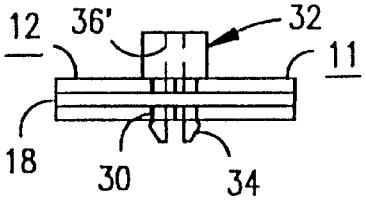
Fig. 14
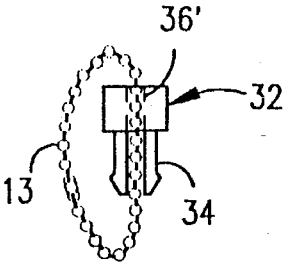
Fig. 16
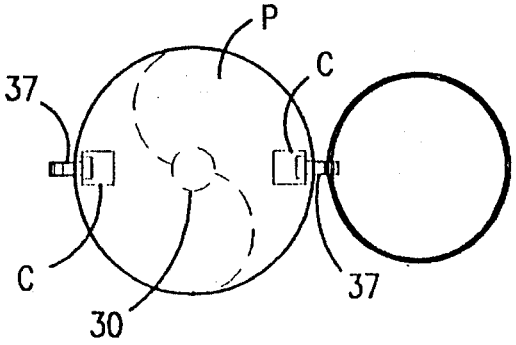
Fig. 17
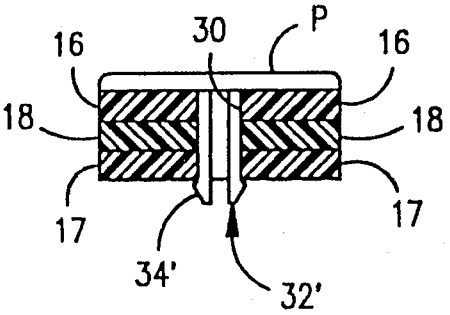

Fig. 18
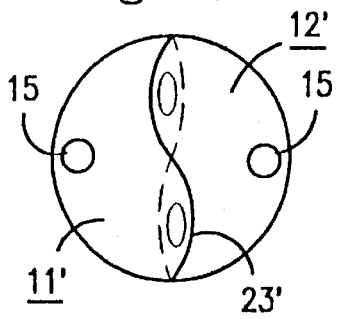
Fig. 19
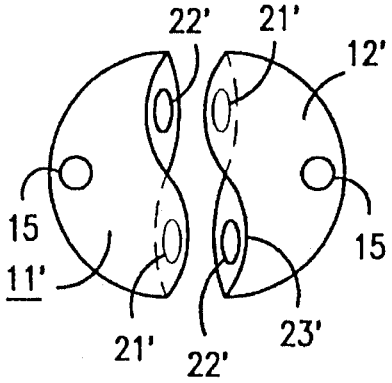
Fig. 19a
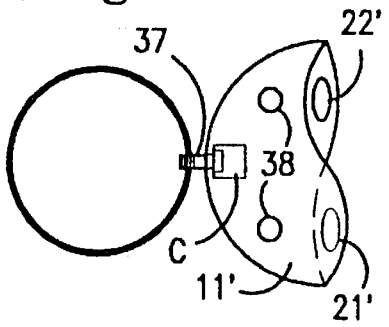
Fig. 18a
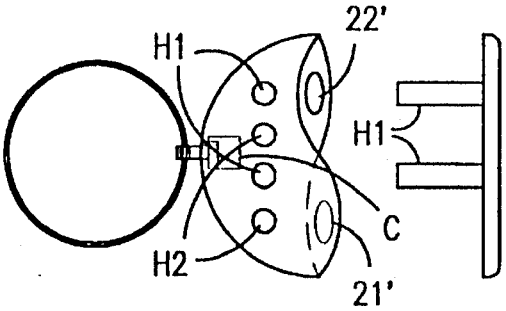
Fig. 21a
Fig. 20
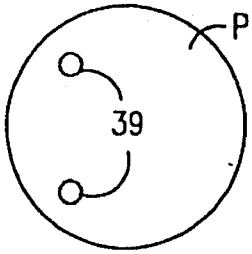
Fig. 21
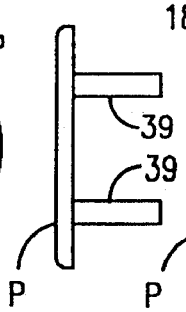
Fig. 22
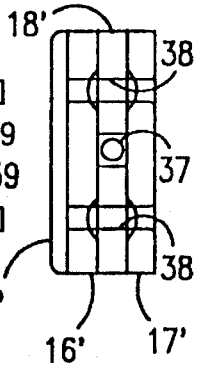
Fig. 23
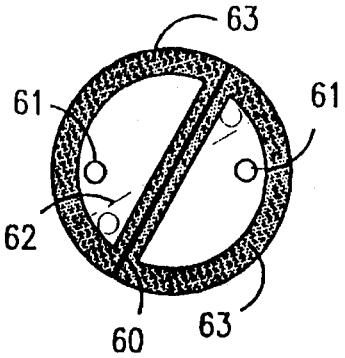
Fig. 24
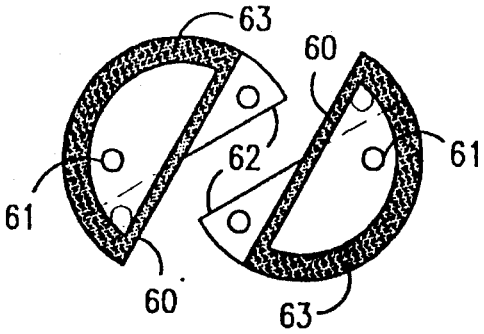
Fig. 25
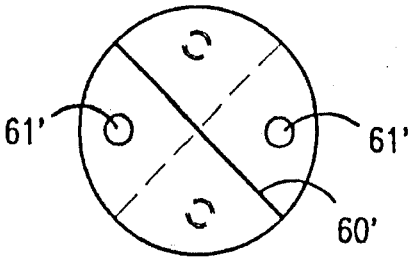
Fig. 26
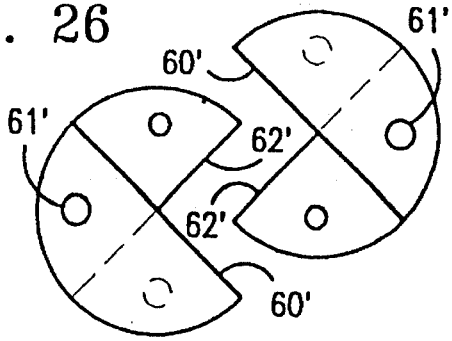

Fig. 35
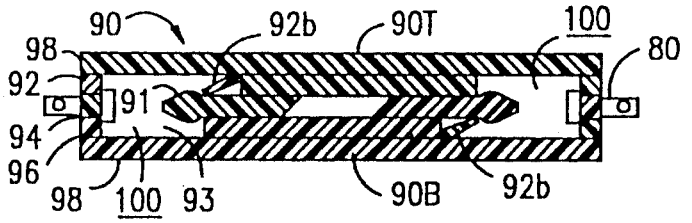
Fig. 36
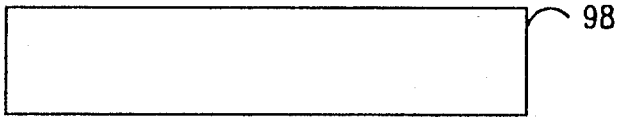
Fig. 37
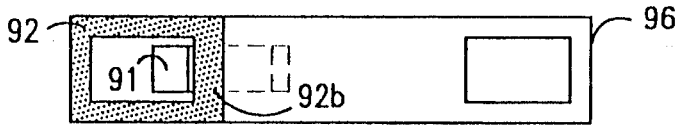
Fig. 38
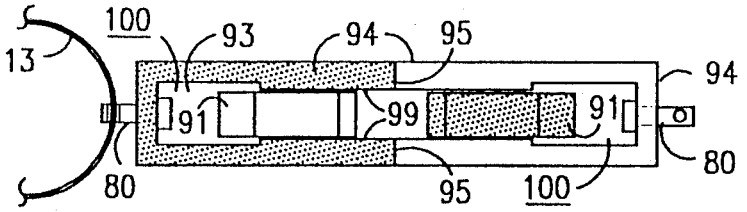
Fig. 39
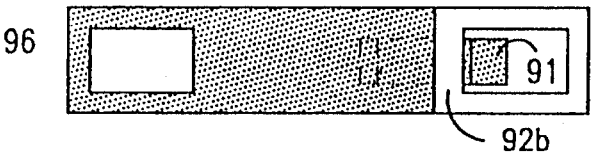
Fig. 40
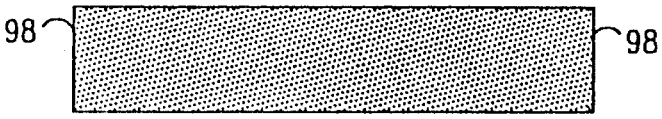
Fig. 41
Fig. 42
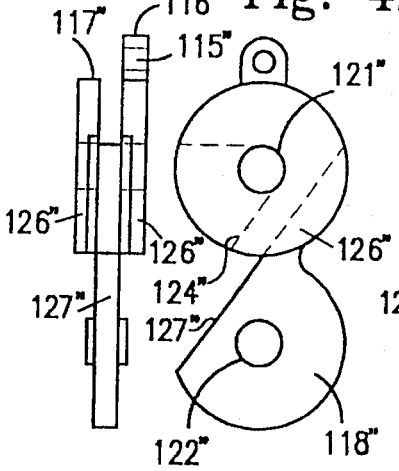
Fig. 43
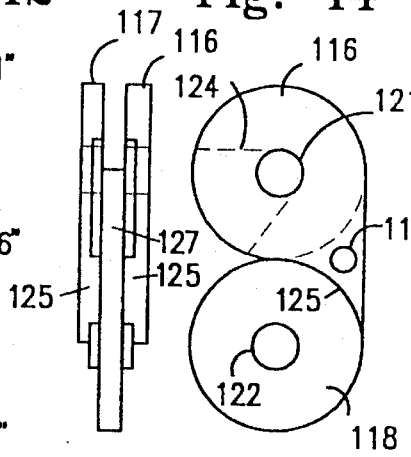
Fig. 44
Fig. 45
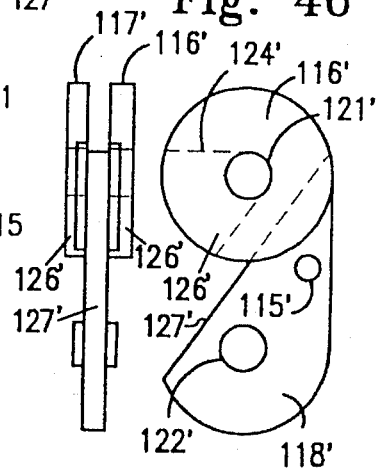
Fig. 46
Fig. 47
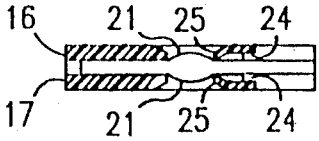

SEPARABLE KEYHOLDER WITH MULTIPLE KEYRINGS

This is application is a continuation in part of application Ser. No. 07/828,242, filed Jan. 30, 1992, now U.S. Pat. No. 07/828,242. The disclosure of that application Ser. No. 07/828,242 contained material in common with an earlier co-pending application of the inventor hereof, Ser. No. 07/732,454, filed Jul. 18, 1991, which was a continuation-in-part of previous application, Ser. No. 07/257,728, filed Oct. 14, 1988, now abandoned.

BACKGROUND OF THE INVENTION

This invention relates to a key holder having two parts which may be latched together and which may releasably interconnect several key rings or key chain loops each holding a plurality of keys having holes through which the loops or rings extend.

Because of the diverse uses usually found for a multiplicity of conventional keys often carried by one person or used at one location such as an office or business site, it is often desirable to collect or carry such keys assembled in a group, but divided into subgroups which may be individually separated from .the group for a variety of reasons, such as to temporarily separate into two or more groups keys for auto ignition, auto trunk, residential or business access, post office box or other common applications.

SUMMARY OF THE INVENTION

In accordance with this invention a key holder comprising two identically shaped parts is latched together by releasable latching means defined by portions of said identically shaped parts. The parts of the key holder are movable to and from their relatively latched positions of engagement merely by manually pushing and pulling the parts toward or away from each other along a particular direction. The pulling of each of said parts is typically achieved by grasping and pulling a key retainer for holding a plurality of apertured keys which is secured to the part. Each of the key holder parts comprises two layers in two parallel spaced strata and having opposed parallel faces defining a space between said layers, and a third layer in a stratum parallel to and between said two parallel strata. The third layer of each part has outer flat surfaces slidable on opposed parallel faces of the other part and in a predetermined direction between said two layers of the other part into said space when said parts are manually pushed together into latched engagement. The releasable latching means for holding the part together comprises at least two distinct relatively spaced pairs of cooperating interfering latching portions, one of the latching portions of each pair being on one of said surfaces of said third layer of one part and the other latching portion of that pair being located on a respective one of said parallel faces of a layer of the other of said parts. The parts of the key holder include resilient means for biasing the latching portions of each pair of cooperating interfering latching portions to their relative latching positions to hold said interfering latching portions against separation except when the parts are pulled apart by an intentional manual separating pull exerted on said key retainers along the aforementioned predetermined direction. The interfering latching portions which define each latching structure interact during the pushing of the parts into latched engagement, and during such an intentional manual separating pull, to displace at least one of the interfering portions of the latching structure against the bias of said resilient means to permit the parts to be respectively moved into latched engagement or completely separated.

The key holder body may be readily provided with locking means such as a separable locking plug which interferes with normal or conventional separation-pulling manipulation. The plug may be of such dimensions and so retained that in its absence a key ring may be retained in its place and permit the body parts to be manipulated by mere separation pulling to release the parts temporarily for detachment of the key ring.

The key holder body is so configured that one or both of the separable parts thereof may have a swiveling key-retaining pin secured thereto in a manner leaving large portions of the body surface unobstructed for the application thereto of artistic, informative or advertising indicia.

The invention also contemplates a composite support structure for several identical interconnected key rings support members. Such a structure may comprise a group of at least three interconnected support members. Each of the members has means for attaching thereto a respective key ring, and each of said members has two separate attachment parts at different locations on said member by means of which each said member may have its attachment parts directly connected to one or more members of said group by manually separable interlocking attachment means formed by mating portions of the connected attachment parts of the respective members at each of said locations, at least one of said support members of said group being manually separable from said group with the remainder of the support members of said group, if more, than one member, being interconnectable by said interlocking mating parts. When two of the separable support members are manually separated from a group of at least three interconnected support members, the two separated members may be interconnected to each other by interlocking attachment parts at two separate attachment locations on each of the respective two separated members.

Among the objects of the invention is to utilize common moldable mutually interlocking parts as a basis for securing together a plurality of key rings or flexible key chain loops.

It is another object of this invention to achieve a low cost simple easily manipulated separable key holder structure having the capability of separably interconnecting two or more subgroups of keys which may be separated from each other while being retained in the respective subgroups and whereby such separated subgroups may be readily reassembled without risking loss of a key by having it separated from a key ring designated for its particular subgroup.

A further object of the invention is to provide a two-part separable structure for mutually securing together two or more key rings wherein the structure has plural surfaces which are useful for artistic decoration or advertising purposes by applying thereto two or three dimensional sculpture or indicia thereto.

Another object of the invention is to provide a basic simple subframe concept for a separable key holder body wherein exterior portions may be so varied in design or added thereto to enable making a variety of three-dimensionally shaped configurations.

Still another object of the invention is to provide a basic simple subframe concept for a separable key holder body wherein an exterior identifying or advertising label may be readily secured to the body as well as being readily changed at the will of the user.

A further object of the invention is to achieve the above object while using several identical key ring members where each member is capable of carrying a group of keys as a subgroup.

Another object of the invention is to provide a simple separable key holder buoy which, when separated, will buoyantly support separate key bearing rings attached to its parts.

Another object of the invention is to provide a relatively flat separable key holder body which lids as flat as possible when retained in a pants or other garment pocket or in a compartment of a purse or business case.

A further object of the invention is to separably interconnect several identical key ring members and enable one or more of the members to be selectively detached or reattached by simply pushing the members together or pulling them apart.

DESCRIPTION OF THE DRAWINGS

FIG. 1 is a plan view of a disk-shaped key holder of the preferred embodiment with two separable parts in their engaged positions.

FIG. 2 is a view similar to FIG. I but with the parts in partially separated positions and showing a chain ring in one of the parts.

FIGS. 3 and 4 are side views of the separable parts of FIGS. 1 and 2.

FIG. 5 is a perspective view of the partially separated parts of FIG. 2.

FIGS. 6–8 illustrate a modified structure similar to FIGS. 1–5 but with different apertures for key rings as the only exposed apertures on opposite faces of the parts when engaged.

FIGS. 9–10 are views similar to FIGS. 1–2 of a modified embodiment having a central hole in each of the parts, FIG. 9 showing a pair of removable rings passing through the holes which are in registration.

FIGS. 11 and 13 are side views of engaged key holder parts of FIG. 9, but with different locking plugs inserted in the center registered holes.

FIGS. 12 and 14 illustrate the locking plugs of FIGS. 11 and 13 respectively, with a key chain ring passing through an aperture in each plug.

FIG. 15 is a plan view of one of the parts of FIG. 9 illustrating dimensional comparison of the center hole with a lateral opening or gap in the side of the hole.

FIG. 16–17 are plan and side views of an embodiment in which the parts are shown engaged and with a cover plate secured thereto by a locking plug attached thereto and extending through a central hole, and with swiveled ring retaining pins extending from side walls of the parts at opposite sides of the key holder.

FIGS. 18–19 are plan views of another embodiment, symmetrical about an axis normal to the center of FIG. 18, and showing engaged and separated parts of a disk-like key holder in which latching structures occupy a smaller portion of the illustrated planar area of the holder.

FIGS. 18*a* and 19*a* each represent half of a key holder of further modified embodiments with swivel type key ring retainers attached at the side peripheral walls of the holder-and having one or more pairs of holes for receiving pins on cover plates like the plate of FIGS. 20 and 21.

FIGS. 20–22 are plan and side views illustrating attachment of an additional disk-like cover plate to a holder as in FIGS. 18*a* and 19*a*.

FIGS. 23–24 are plan views of engaged and separated parts of another embodiment of a key holder, symmetrical about an axis normal to the center of FIG. 23, and in which the abutting edges of the respective layers in different strata are all straight and the illustrated face is in intaglio relief.

FIGS. 25–26 are plan views of engaged and separated parts of another embodiment of a hey holder, symmetrical about an axis normal to the center of FIG. 25, and in which the abutting edges of the respective layers in different strata are all straight and diametrical, and the opposite faces of the key holder body are flat and parallel.

FIG. 35 is a section along a central lengthwise vertical plane of an elongated five-layered key holder body having two principal engaged separable parts forming the shape of a parallelpiped block. The block has an essentially square transverse section throughout and has, on the two separable parts of the key holder body, collinearly oriented male members which move along a central stratum to and from latched positions in respective female structures in the respective opposite parts.

FIGS. 36–40 are, respectively, separate views illustrating the structure of the parts of the body in the five layers as seen progressing from the top layer to the bottom layer of FIG. 35.

FIGS. 41–42, 43–44 and 45–46 are sets of front and side views of three different key holder body components each of which can be mated with an identical twin component to define a body having two engaged and relatively latched parts with the general appearance of the figure "8".

FIG. 47 is a section through the center of a pair of superposed protuberance-retaining holes in spaced strata and illustrating conical relief spaces outside the hole edges permitting outward deflection of the hole edges without interfering with surfaces which may overlie the outer ends of the holes.

FIG. 63 shows a linear array of three key ring supporting members with one key ring shown attached to the center member which is connected in a reversed position.

FIG. 64 is a broken section on line A—A and B—B of FIG. 63 showing the configuration of the male and female portions at opposite ends of one key ring supporting member.

FIG. 65 shows two of the supporting members of FIG. 63 connected to each other.

FIG. 66 is a view similar to FIG. 65, but showing the members complimenting each other to fill the central area between the respective attaching locations.

FIGS. 67 and 68 illustrate another embodiment of the invention which has key ring supporting members which can be connected in arrays of two or more members, three being shown in FIG. 65 and two being shown in FIG. 66.

DESCRIPTION OF THE PREFERRED EMBODIMENT

Figure 27:
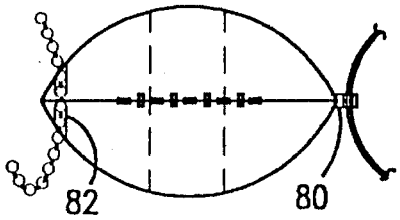
FIGS. 27–29 are top, end and side views of a five-layered key holder body in the shape of a miniature football and having two separable major structures.

In the embodiment 1 of FIGS. 1–5 a key holder 10 comprises two identically-shaped mating parts 11 and 12 which may be engaged to define a relatively flat circular plate-like or disk-like key holder body having parallel flat outer faces and which parts are retained in their engaged positions by means of latching structures which allow the parts to be separated by merely pulling them apart manually. Each of the parts 11 and 12 will have attached thereto a conventional key retainer 13 for a plurality of apertured keys and in the form of a chain or a metal or plastic split key ring which is a flat circular ring having a two-turn helical configuration enabling the apertures of one or more keys to be threaded around the turns and onto the ring. Each ring is engaged within a suitable aperture 15 in a respective one of the key holder parts 11 or 12. Throughout the invention descriptions herein, reference to a split key ring or a beaded chain key ring are deemed to be equivalents unless otherwise specifically stated.

Each of the parts 11 and 12 has first and second outer flat parallel spaced layers 16 and 17 and a third layer 18 parallel to layers 16–17 and offset with respect thereto. Each of layers 16-18 is of essentially the same thickness and stratawise the third layer is in a stratum between layers 16 and 17. The parts 11 and 12 may be oriented so that the layers 16 and 17 of one part 11 have parallel flat inner faces which form a female cavity into which the third layer 18 of the other part 12 may be inserted as a male member. Vice versa and simultaneously, the layers 16 and 17 of that other part 12 form a female cavity into which the third layer 18 of the one part 11 may be inserted as a male member. Each layer 18 has a web-like pointed extension or nose 19, tapering in thickness toward its tip, which tip is shown in FIG. 2, just slightly extending into the space between the members 16–17 of the other part to at least initially facilitate manually guiding the layer 18 into position between the respective layers 16–17. Upon further movement of the parts 11 and 12 toward each other the edges of the respective layers 16 and 17 of one part interact with corresponding respective layers of the other part to assist in guiding the parts precisely into engaged latched positions. The edges of layers 18 may also interact to assist in the guiding of the parts into their engaged position.

At least one of the layers 16 and 17 of each part has a hole or recess 21 receding from its inner face for receiving and releasably retaining a cooperating raised or projecting button or protuberance 22 on, and raised slightly above, the respective parallel face or faces of the layer 18, such a cooperating recess and protuberance defining a latching structure by means of which the parts 11 and 12 are latched together. As indicated in FIGS. 3–4 and 6–8, these protuberances 22 are guided to the respective recesses 21 and 21 by guiding channels 24 on inner faces of respective outer layers 16 or 17. The layers 16 and 17 are resilient and may be sprung apart sufficiently by the insertion of a layer 18 with its protuberance(s) until each such protuberance snaps into a respective hole 21 whereupon the inwardly facing parallel surfaces of the parts 11 and 12 engage the opposite respective outwardly facing flat parallel surfaces of the intermediate layer 18. To make the edges of the holes 21 more easily flexed, the outer faces of a layer containing a hole 21 may be indented with a shallow conically recessed exterior surface 25 coaxial with the hole 21 as seen in FIG. 47 which shows a section through the center of a pair of superposed protuberance-retaining holes in spaced strata of one part and illustrates shallow conical relief spaces formed by the surfaces 25 at the outside of the hole edges permitting outward deflection of the hole edges without interference from other surfaces which may overlie the outer ends of protuberance-retaining holes 21 at the ends of the guiding channels 24. In the embodiment of FIGS. 6–8 the recesses 21' which receive the protuberances 22 do not extend to the outer surfaces of the parts 11 and 12, leaving only the apertures 15 for key rings as the only exposed apertures on opposite faces of the engaged parts 11 and 12. The apertures 15 where the rings are secured to the parts 11 and 12 in FIGS. 1, 2 and 6 are at spaced points essentially along a line which is parallel to the direction in which a pulling force is exerted by the key rings when manually pulled to separate the key holder parts.

When the parts 11 and 12 are engaged the opposite outer faces of the key holder have an S-shaped separation line 23 between layers 16—16 and a mirrored S-shape separation line between the layers 17—17. The edges of the layers 16 and 17 which define these separation lines slide upon one another to help guide the parts 11 and 12 to their engaged positions. The parts 11 and 12 may be manually pressed together to their engaged positions by pressing on diametrically opposite points. The only manipulation of the parts 11 and 12 required for their separation is effected merely by pulling the rings 13 in apertures 15 in opposite directions to force the protuberances 22 outwardly under the retaining edges of the holes 21.

The embodiments of FIGS. 9–15 are similar to the embodiment of FIG. 1 except for the addition of a hole 30 of approximately the same diameter as holes 21 and located at the point of inflection of the S-shaped separation line 23. The hole 30 is essentially half in part 11 and half in part 12. Since a tangent to the separation line at the point of inflection is essentially perpendicular to a line connecting the centers of the holes 21 when the parts are engaged and parallel to the direction in which the rings 13 in apertures 15 would apply a pulling force for separation, separation of the parts may be prevented by locking means comprising a plug 32 inserted into the hole 30 to engage portions of the three layers 16–18 at the edges of hole 30 to block their relative separating movement. The axis of the holes 30 passes through the points of inflection of the S-shaped separation lines 23 and the plugs 32 are coaxial therewith.

The geometrical arrangement of the parts 11 and 12 at the hole 30 is more easily understood by referring to FIG. 10 where the parts are shown partially separated after the locking plug is removed and the edge of the hole 30 for each part is shown. Near the point where the edges of layers 16 and 18 converge and intersect the edge of the hole 30, the points of such intersections A and B are spaced a distance equal to about one half the diameter of hole 30 as seen in FIG. 15. Thus neither part 11 nor part 12 could be pulled off the side of the plug 32, the diameter of which is represented by the larger circle to the right of FIG. 15.

The locking plug 32 seen in FIGS. 11–14 has a shouldered portion 33 of greater diameter than the hole 30 and abutting the layers 16 at the sides of the hole 30. The locking portion of the plug within the hole is formed by means of a plurality of resilient fingers 34 extending axially from the shoulder 33 through hole 30 and having at their projecting tips transversely outwardly extending latching and camming portions 35 which assist the user in manually inserting or withdrawing the plug relative to the hole. When inserted, the portions 35 overlie the adjacent edge of the hole 30 to prevent inadvertent withdrawal of the plug 32. The resiliency of the fingers 34 is such that a reasonably strong manual pull on the plug is required for its removal. The shouldered end of the plug may have an aperture 36 extending transversely therethrough as seen in FIGS. 11–12 for reception of a key ring or chain loop. The key ring is an aid to applying a pull-out force to the plug as well as providing an additional ring for a key which might be removed from the key holder 10 and left with a parking attendant or the like.

A variation of the configuration of a locking plug is shown in FIGS. 13–14 where an axial passage 36 is provided through the plug to accommodate a chain key ring looped from end to end through the plug and externally therearound. Sufficient clearance is provided between the inside surfaces of the fingers and the chain to permit the fingers to be deflected inwardly toward the chain to allow insertion or removal of the plug from the hole 30. In this case the chain ring remains in the hole 30 during insertion and removal of the plug. The diameter of the chain ring within the hole after the plug is withdrawn from the hole and along the chain ring is of such lesser size than the locking plug portion of this separable key ring that the parts 11 and 12 can then be removed from the chain which can escape from each hole through the space between the aforementioned intersection points A and B shown in FIG. 15 wherein the chain key ring diameter, which is smaller than the diameter of plug 32, is represented by the smaller circle to the right of FIG. 15. To assist in pulling the plug 32 from the hole, the shouldered portion may also be provided with a knurled or grooved peripheral gripping surface.

FIG. 16–17 are a plan and a simplified side section of an embodiment in which two parts similar to those of FIG. 10 are shown engaged and with a cover plate P secured to the end of a locking plug 32' attached thereto and extending through the central hole 30 to lock the keyholder parts in their latched positions. Swiveled key ring retaining pins 37 extend in opposite directions from small chambers C which retain the shoulders of the swivel pins in the sidewalls of the respective engaged parts at opposite sides of the key holder. FIG. 17 illustrates the arrangement of a plurality of resilient shouldered fingers 34' of the locking plug 32' which occupy hole 30 to hold the key holder parts against separation in the manner of FIGS. 10–15

In the embodiment of the invention illustrated in FIGS. 18–19 the two parts of the key holder define a circular plate-like body similar to FIG. 1, but in this embodiment the parts 11' and 12' are shaped so that the S-shaped separation line 23' is much flatter so that a tangent to this curve at its point of inflection at the center of the key holder body is at an acute angle of approximately 45 degrees with respect to a line interconnecting the cooperating latching protuberances and recesses on each body part. The retaining recesses 21' and protuberances 22' are also elongated in the direction generally parallel to the separation line 23' and transversely with respect to the direction of relative separation of the parts effected by pulling on key rings secured to the key holder parts. Each body part comprises three layers similar to the layers 16–18 of the earlier described FIGS. 1–4, but the means for attaching a key ring to each of the two body parts may be different, as seen in FIGS. **18*a* and 19*a*, each showing one of two identical mating parts of the key holder. Here the middle one 18' of the three layers is provided with a small rectangular chamber C near the center of its arcuate outer wall portion with a notch or hole through this outer wall portion. A rotatable shouldered pin member 37, having its shoulder abutting the inner wall of the chamber C, extends outwardly through the notch or hole and has secured to its outer end, outside the key holder body, a suitable key ring. The top and bottom of the chamber C may be covered by portions of the two outer layers 16' and 17'**.

A further variation of the key holder body is provided in FIGS. 20–22 where a circular cover plate P essentially diametrically coextensive with the plate-like body 10 formed by the engaged pair of three-layer body parts. To keep the structure of each of the two key holder body parts identical, one outer cover plate is secured to each part. As seen in FIGS. 21–22, each plate is secured to its respective body part by means of a pair of pins 39 which extend perpendicularly with respect to the plate P and penetrate into and are suitably secured in holes 38 in one or more of the layers 16'–18' to secure (preferably irremovably if part of an advertising indicia) the plate P thereto. The holes 38 are so located that pins located therein do not interfere with intended relative movement of the interleaved layers or strata of the key holder parts during their engagement or separation. If such cover plate is made readily removable as by a mere friction fit of the pins 39 in their respective holes, the plate may be changed from time to time at the will of the user to provide different identification of the user or grouping of the keys attached thereto.

The three principal layers of each body part may be molded together as an integral unit with the holes 38 molded therein and the cover plate P added thereafter. This enables a large number of such units to be made for common components of key holders having different artistic works or advertising logos on, and different material colors for, the cover plates which can be easily selected or changed as needed. If the three layers are molded together, the chamber C may be formed therein as shown in FIGS. 16, **18*a*, 19*a***, 29 and 38 to provide means for attaching or inserting the shouldered pin member 37.

If two offset pairs of holes H1 and H2 are provided in each part of the key holder, and the two pins 39 on the cover plate of FIG. 21*a* correspondingly offset, as shown in FIG. 18*a*, identical cover plates can be attached to separate parts 11' and 12' or two plates can be secured to respective opposite faces of one key holder part. In such case, the other key holder part is then merely slid between the two cover plates for engagement of the parts.

An example of a key holder in accordance with this invention and having outer surfaces embodying a design or indicia in intaglio or depressed type relief is shown in FIGS. 23–24. Here the indicia represents the well-known international prohibitory or "NO" background such as is seen in signs for traffic regulation. The separation line 60 along and between the abutting edges of the outer layers of the parts, on the principal illustrated face of the body as well as at the rear face, is straight or linear and at an angle of approximately 45 degrees from lower left to upper right with respect to an imaginary horizontal line connecting the two holes 61 provided for the addition of key rings to the two body parts. The separation line 62 along and between the abutting edges of the center layers of the key holder parts is also straight or linear and is at an angle of about 22.5 degrees relative to line 60 as seen in FIGS. 23–24. The latching structures of this embodiment are located along a line midway between lines 60 and 62 in the acute angle defined by these lines. The two D-shaped peripheral raised portions 63 together form the "NO" indicia and the recessed central portions of these D-shapes may be provided with any suitable correlated indicia as well as providing loci for the holes 61.

FIGS. 25–26 depict another embodiment in which the opposite outer faces of a disk-like key holder body are flat parallel surfaces and in which the separation line 60 along and between the abutting edges of the outer layers of the parts, on the principal illustrated face of the body as well as at the rear face, is straight or linear and at an angle of approximately 45 degrees from lower right to upper left with respect to an imaginary horizontal line connecting the two holes 61' provided for the addition of key rings to the two body parts. The separation line 62' along and between the abutting edges of the center layers of the key holder parts is also straight or linear and is perpendicular to line 60' as seen in FIGS. 25–26. The latching structures of this embodiment are located along a line midway between lines 60' and 62' and perpendicular to the line connecting the holes 61'.

For FIGS. 23–26 the latching means comprising the cooperating pairs of interfering protuberances and protuberance-retaining recesses function like those of FIGS. 1–2 and 18–19.

Figure 28:
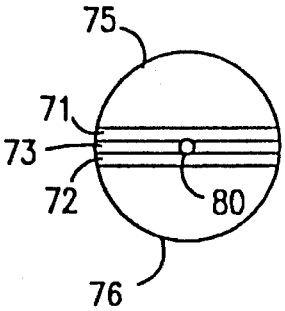
Figure 29:
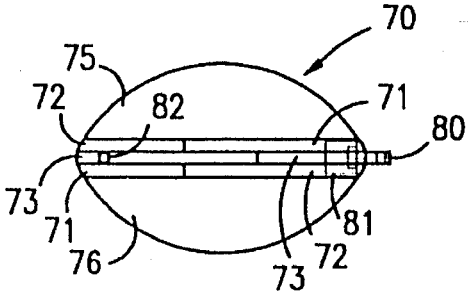
Figure 30:
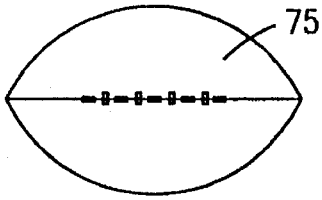
FIGS. 30–34 are, respectively, separate views illustrating the structure of the portions of the body in the five layers as seen progressing from the top layer to the bottom layer of FIGS. 28 and 29.
Figure 31:
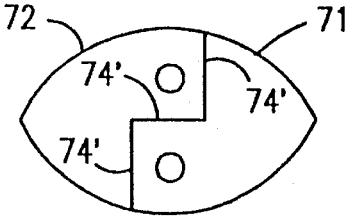
Figure 32:
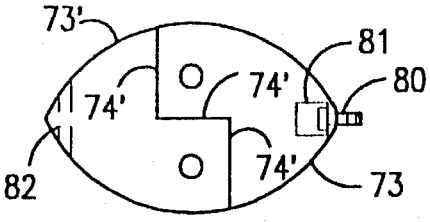
Figure 33:
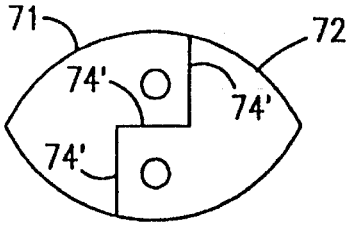
Figure 34:
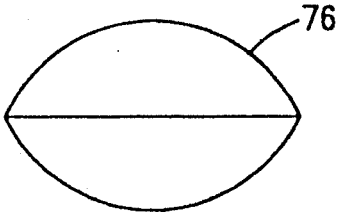

An example of a key holder in accordance with this invention and having outer surfaces embodying a design or indicia in cameo or raised type relief is shown in FIGS. 27–29. Here the body 70 of the key holder design represents a football having much greater three-dimensional (3-D) depth than the previously described plate-like embodiments. To facilitate depiction of the layers of the football body 70, the respective flat parallel layers 71, 72 and 73, corresponding to layers 16, 17 and 18, respectively, of the first described embodiment, are drawn in separate views. The separation lines are zig-zag lines as seen at 74 where separation line portions 74' extend transversely with respect to the football' longitudinal axis, whereas the separation line portion 74" extends parallel to this axis. The cover layers 75 and 76 providing most of the external 3-D surface area of the football shaped key holder body may be secured to the respective body parts in any suitable manner.

The key rings for the football body 70 may be attached as shown at one end by a shouldered swiveling pin 80 projecting from an internal chamber 81 in the tip of the football body 70 in a manner similar to that described in connection with FIGS. 18*a* and 19*a*. Alternatively the key ring may be attached by passing a key ring through a suitable aperture 82 drilled across the body through layer 73.

In all of the embodiments thus far described, there are three principal flat, parallel, stacked layers, in identically shaped body parts, wherein the central layers form male members pointing in opposite directions and wherein the layers have cooperating and mating protuberances and recesses defining essentially one or more side-by-side pairs of latching or retaining structures. However it is also within the spirit of this invention to arrange such flat, parallel, stacked layers of identically shaped parts so that the pairs of mating protuberances and recesses define pairs of latching or retaining structures arranged end-to-end.

FIGS. 35–40 illustrate an elongated rectangular parallelpiped block 90 defined by two identical mating key holder parts 90B (bottom) and 90T (top) relatively moveable endwise to or from latching engagement with each other. The bottom key holder part 90B in which the left swiveled key ring is secured comprises four flat parallel members each extending from the left end of block 90 and forming four lowermost stacked layers or strata of the five layer block 90. The four layers of part 90B from top to bottom as seen in FIG. 35 are: (1) a flat short rectangular layer member 92 with a central rectangular opening 93; (2) an intermediate length U-shaped layer member 94 having legs 95 extending half the length of the block 90; (3) a longer rectangular layer member 96 of a length equal to the length of the block 90 minus the length of the short rectangular member 92; and, (4) a rectangular cover plate layer 98 extending over the entire bottom face of the block 90. The top key holder part 90T comprises from bottom to top four identical layers 92, 94, 96 and 98, each extending from the right end of the block 90, with the layers 92, 94 and 96 of part 90T being in the same respective strata as layers 96, 94 and 92 of part 90B.

Each part has a pair of parallel flat spaced layers or strata 92 and 96 defining the top and bottom of a female recess in a first end of the part near an end of the block and a central layer or strata 94 therebetween in which is located, in the other end of the part, a flat nose-like member 91 parallel to the spaced parallel layers 92 and 96 and pointing away from the first end of the part and toward the other end of the block 90.

The flat nose-like member 91 for part 90B is centrally secured atop the right end of layer member 96 and projects beyond the end of member 96 toward the right end of block 90. The identically shaped and essentially collinear nose-like member 91 for part 90T is similarly secured to the underside of the left end of layer member 96 of part 90T. Each of the layer members 94 and 96 has an open rectangular area, 93' and 93", respectively, in registry with the rectangular opening 93 of layer member to define a chamber 100 in the end of the respective part for receiving the portion of the opposing male member 91 to be latched therein. The inner side faces 99 of the legs 95 of the U-shaped layer 94 of each part cooperate with the layers 92 and 96 of the respective part to not only define all four sides of the female recess which receives the male member 91 of the other part, but also to form a channel to guide that male member 91 into the female recess. The upper and lower surfaces of the members 91 have raised protuberances 101 which pass under a resilient bridge portion 92*b* of the short layer member 92 and deflect this bridge member upwardly sufficiently for such passage. After passing beyond the bridge 92*b* and when the parts are fully engaged, the resiliency of the bridge and of the member 91 causes the bridge to snap behind one of the nose's protuberances and forces the other protuberance on the resiliently deflectable member 91 to drop below and be retained by an edge portion of the rectangular opening in the layer member 96.

The chambers 100 also provide a means for placing shouldered swiveled key ring retaining pins from the inside outwardly through holes in the outer wall portion of layer member 96 for attachment of a swiveled key ring to one end of each key holder part 90B and 90T.

In the embodiments of FIGS. 27–40, the football-like and block configurations may have sufficient volume of low density plastic portions in each of the two separable parts so that each of the two key holder parts will have sufficient buoyancy to keep afloat in a body of water the respective key ring thereon. In any of the embodiments where a key ring retainer is inserted into a hole in the external wall of a key holder part, i.e. FIGS. 16, 18*a*, 19*a*, 27 and 38, a plug-like structure similar to that of FIGS. 11–12, but of smaller diameter and with snap in non-removable shoulders on the fingers and perpendicular to its axis could be used.

In each of the three embodiments of FIGS. 41–46, there is illustrated only one mating part of a flat key holder body which is made up of two identical such engaged mating parts to define the general shape of the numeral 8. Each part of the body has a first end comprising two flat annular resilient members 116 and 117 in parallel spaced strata and a second end forming a single flat stratum or web portion member 118. Each annular member 116 and 117 of one such engaged part has a central retaining recess 121 for closely encircling and retaining a respective protuberance 122 on the adjacent face of the web or stratum 118 of the other engaged part to form a latching structure to aid in holding the engaged parts together.

The protuberances engage the inner opposed outwardly diverging faces of the annular members as the protuberances are pushed toward the holes 121 and spring the resilient annular members apart until the edges of the hole snap into position over the respective protuberances to retain the latter to securely fasten the parts of the key holder together. The edges of the holes and of the protuberances permit the parts to be separated from their engaged positions by exerting only a predetermined manual pulling force in opposite directions on key rings in the holes 115 of the two mated parts.

In FIGS. 43–44 the generally triangular portion of each part having the ring receiving hole 115 therethrough has a thickness equal to the thickness of the three strata of the members 116, 117 and 118. This triangular portion has surfaces 125 which form extensions of layers 116 and 117 to provide S-shaped edge configurations of these layers above and below the web or stratum 118 which abut and complement the complementary peripheral shape of the extended annular members 116 and 117 of the other part when the parts are engaged. Similarly this triangular portion has a surface 127 in the stratum 118 between the two annular members 116 and 117 which abuts and complements the same peripheral shape 127 of the web portion 118 of the other part when the parts are engaged. These complementary surfaces aid in guiding the parts and latching structures together when they are manually pushed together.

Figure 48:
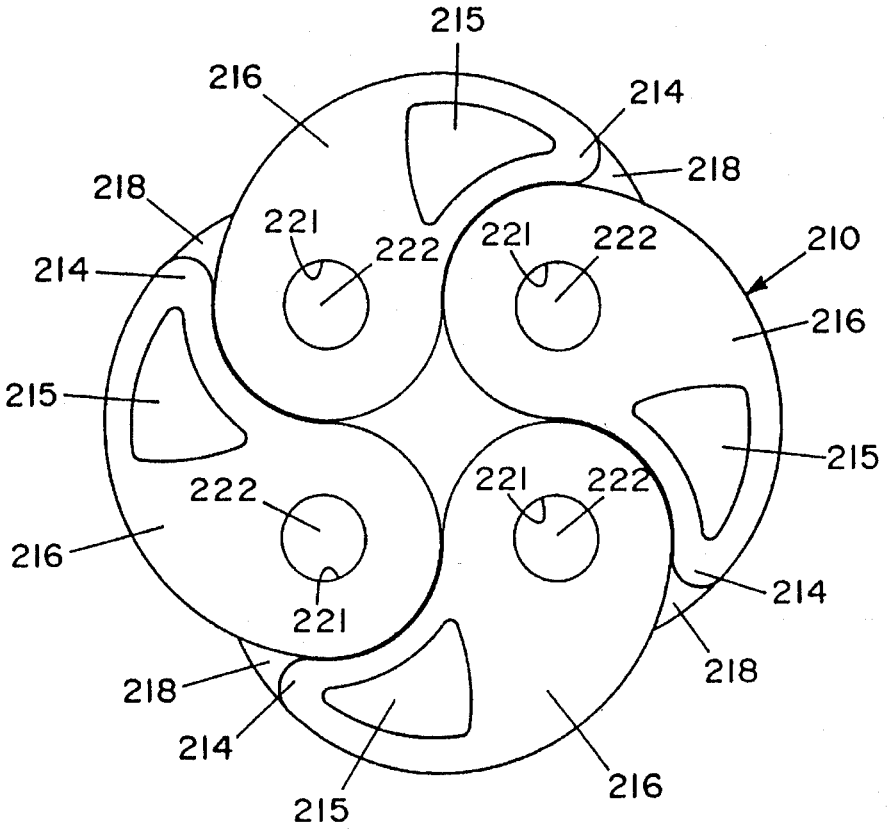
FIG. 48 is a plan view of a multi-sectioned key holder of a preferred embodiment having more than two identical separable key ring supporting members in their engaged positions, but with the rings omitted.

In the embodiment of FIGS. 43–44, the illustrated member is intended to be connected to another identical member by engaging the protuberance parts 122 on opposite faces of the male web strata 118 of each member between the annular strata parts 116–117 of the other member with the protuberances 122 projecting into the retaining recesses 121. The centers of the engaged sets of coaxial protuberances and coaxial retaining recesses define parallel pivot axes extending perpendicular to the three strata 116–118. By leaving one set of coaxial protuberances retained within its respective coaxial retaining recesses at the other part, the other set of protuberances can be pulled and swung out of its retaining recesses and swung through an arc of approximately 180 degrees about the pivot axis at the retained coaxial protuberances so that the two key ring support members then extend end to end with the key ring openings 115 along one side of such a structure. The relative angular movement of two such interconnected members is limited only by engagement of portions of the strata 116–118 of one member with portions of the generally triangular portions of the strata of the other member through which the key ring receiving hole 115 passes. More than two members can be connected together in an end to end chain. Moreover, such an end to end chain can have its ends connected together to form a loop or ring of any desired number of members. A loop or ring of four key ring support members is shown in the embodiment of FIG. 48. Also any member in the chain may have its faces reversed relative to the faces of the other members of the chain in the manner illustrated in other embodiments of FIGS. 63 and 67 described hereinafter.

In the embodiments using two engaged parts like the one shown in FIGS. 41–42, or two parts like the one shown in FIGS. 45–46, the parts are guided together by engagement of the peripheral edge surfaces 126", 126' of the annular members of one part with corresponding surfaces 126", 126' of the annular members of the other part to be engaged and by engagement of web edge surfaces 127", 127' of the respective webs of the parts to be engaged.

The preferred embodiment for a support structure comprising at least three identical key ring supporting members is shown in FIG. 48. In this embodiment the four members forming the structure 210 are each identical and the details of each member are shown in FIGS. 50–53. In this embodiment, there are in each of the identical members three principal flat, parallel, stacked layers 216–218, wherein the central layers 218 form flat male blade portions carrying protuberances 222 at one end of each member and the parallel spaced curved teardrop shaped layers 216 and 217 define a flat female receiver for the male blade of another member. The upper curved teardrop shaped layers 216 have protuberance-retaining recesses 221 to define essentially one or more side-by-side pairs of latching or retaining structures to hold the key ring supporting members in engagement. Guiding channels 224 in layers 216 function like channels 24 of FIGS. 1–6 to guide and ease the movement of the protuberances 222 into the recesses 221. Each of the members has an aperture through the layers 216-218 essentially between the recess 221 and the protuberance 222 and perpendicular to the layers for receiving a suitable conventional key ring 213 of split ring or chain configuration. The structures of these members of FIGS. 48 and 50–53 are essentially the same as the mating parts 11 and 12 of FIGS. 1–6 with the following exceptions. The nose 19 and the ends 14 of FIGS. 1–6 interfere with any relative angular pivotable opening movement of two engaged members. Therefore the nose 19 on each part of FIGS. 1–6 has been modified to the rounded configuration on the blade 218 in FIGS. 50 and 52 so as to be essentially concentric with the adjacent protuberance 222. Also the sharp acutely angled ends 14 of the teardrop shaped layers 16 and 17 of FIGS. 1–6 have been shortened and rounded as at 214 in the layers 216 and 217 of FIGS. 50 and 52 to enable relative angular pivoted opening movement of two engaged members about a respective pivot axis perpendicular to the layers 216–218 and centrally of a respective protuberance 222 forming a pivoting means.

Figure 49:
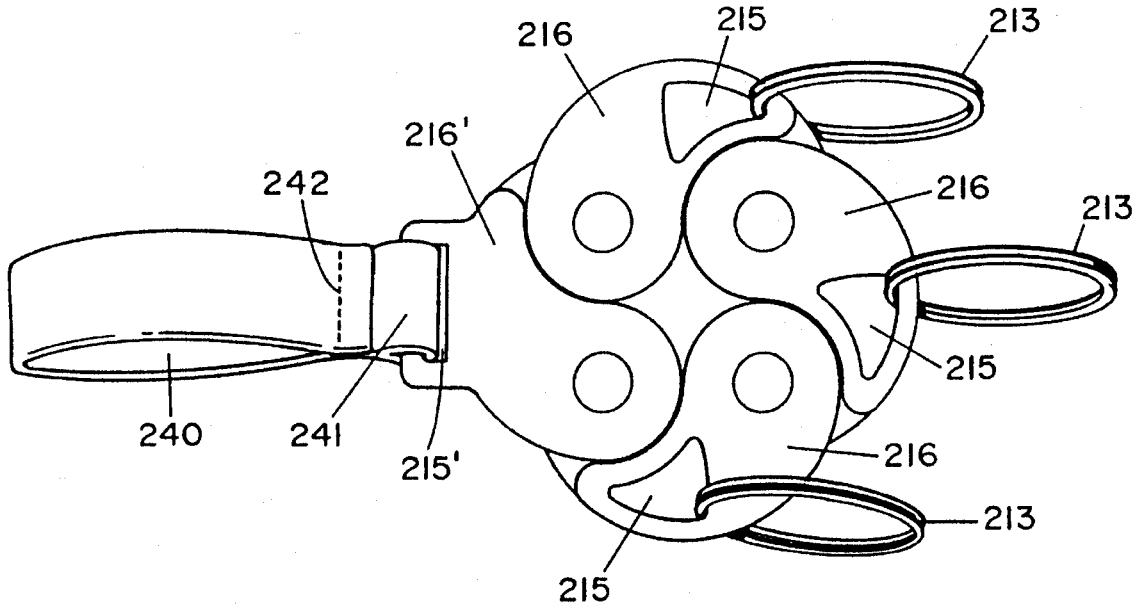
FIG. 49 is a plan view of a multi-sectioned key holder embodiment similar to FIG. 48 and having three separable key ring supporting members in their engaged positions, with the three members each fastened to a carrier having a belt loop secured thereto.
Figure 50:
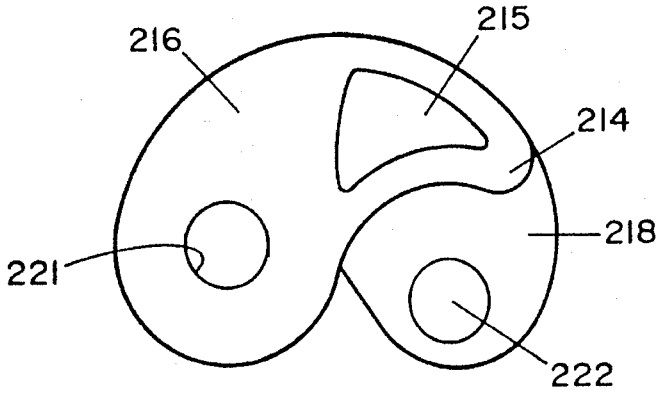
FIG. 50 is a plan view of one of the key ring supporting members used in FIGS. 48 and 49.
Figure 51:
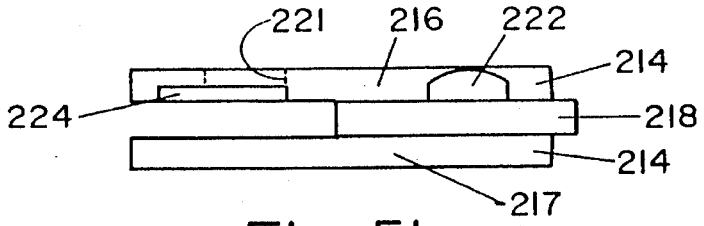
FIG. 51 is a front view of the key ring supporting member of FIG. 50.
Figure 53:
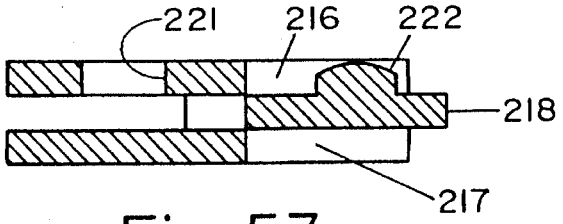
FIG. 53 is a section at a plane centrally through the female hole and the male projection of FIG. 52.
Figure 52:
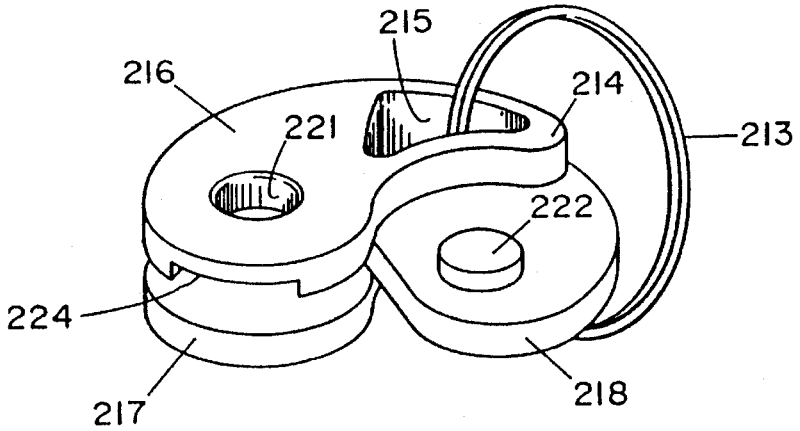
FIG. 52 is a perspective view of the member of FIGS. 50 and 51 with a key ring attached and showing a male projection and a female hole, the projection and hole being attachable to corresponding mating portions of another like member.

The embodiment shown in FIG. 49 with key rings 213 in place is essentially the same as in FIG. 48 except that one of the supporting members having the upper surface 216 has a modified shape around a strap aperture 215' which replaces a key ring aperture 215. This aperture 215' passes through other layers or strata shaped similarly to layer 216' at the aperture 215' and corresponding to layers 216–218 of the other members. A strap 240 has a small loop 241 passing through and secured at the aperture 215' and a major loop for securing it to a belt or other object from which the key ring structure is to be supported. The major loop may be stitched closed at 242 or it may be secured at the location of 242 by conventional openable hook/loop fasteners (not shown).

Figure 54:
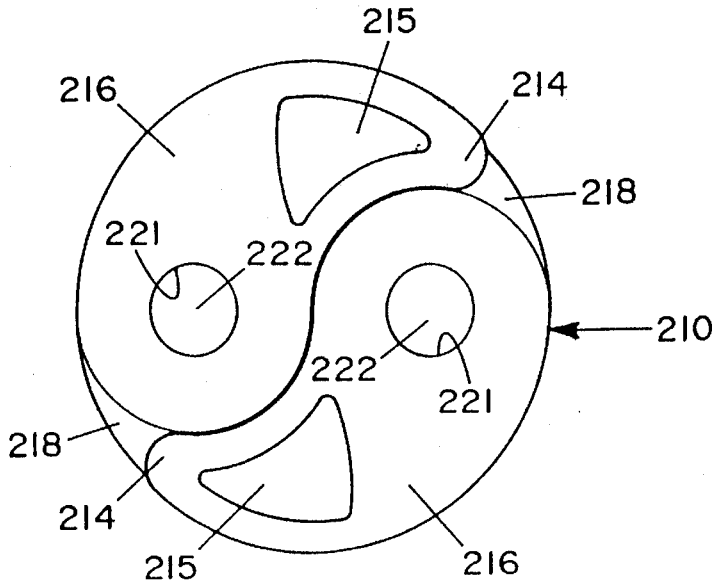
FIGS. 54 and 55 are views similar to FIG. 48, but utilizing only three and two, respectively, of the same identical separable key ring supporting members in their engaged positions.
Figure 55:
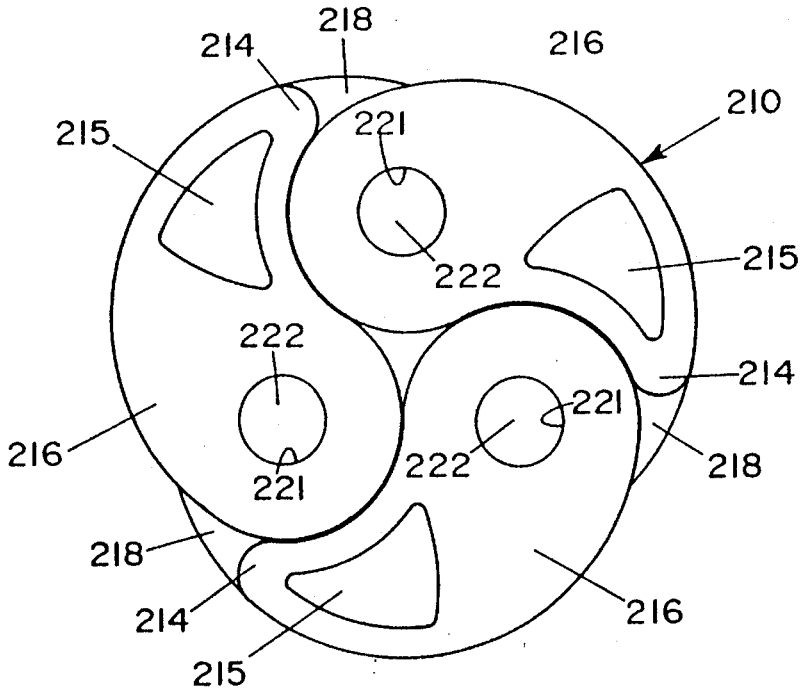

The embodiments of FIGS. 48, 54 and 55 show how members identical to those of FIG. 48 can be combined in sets of two, three or four interconnected members. The round configuration of two members in FIG. 55 is approximately 1⅜ inches in diameter and about ¼ inch thick.

In the embodiments of FIGS. 43–44, 48–55, and 63–68 the key ring supporting members provide means for pivoting movement of each member relative to another member connected thereto to enable more than two members to be connected end to end in a chain or loop. Relative angular pivoting movement of two connected members as described in connection with FIGS. 43–44, 65, 66 and 68 through an angle of 180 degrees enables the members to extend end to end in a straight line or to have any number of members added to the end to end chain. If additional members are to be added and formed into a regular polygonal or closed loop, it is only necessary that the relative angular opening movement of the members be sufficient to open up the gap at the free ends of the members to enable insertion of a desired numbers of additional key ring support members connected end to end. Such angular opening movement must be at least equal to (180–360/n) degrees where n is the total number of support members in the ring or loop. For example, in going from FIG. 55 to add another member to achieve the three-member ring or loop of FIG. 54, the two members of FIG. 55 need to be angularly opened through an angle of at least 60 degrees. However to go from FIG. 55 to the four-member ring or loop of FIG. 48, the relative angular opening movement of the two members of FIG. 55 must be at least 90 degrees.

The embodiment of FIG. 48 exhibits a unique phenomenon in that not only can the members be separated as desired by pulling on the key rings in the apertures 215, but also the four members can be caused to snap abruptly from the illustrated four member configuration to two sets of two interconnected members as in FIG. 55 by manually applying with two fingers opposing squeezing forces at the perimeter of the structure of FIG. 48 where two diametrically opposite blade layers 218 are seen exposed. Such squeezing forces are essentially along a line through the centers of opposite protuberances 222 which are initially pushed toward each other and the corners 214 force separation of these opposed protuberances from their mating recesses 221. Continued inward application of the squeezing forces on all the members produces relative angular movement of the sets of members which remained pivotably interconnected at the ,other protuberances, whereupon the separated protuberances very rapidly snap across the center of the illustrated structure and into secure engagement with the vacated recesses 221.

Figure 56:
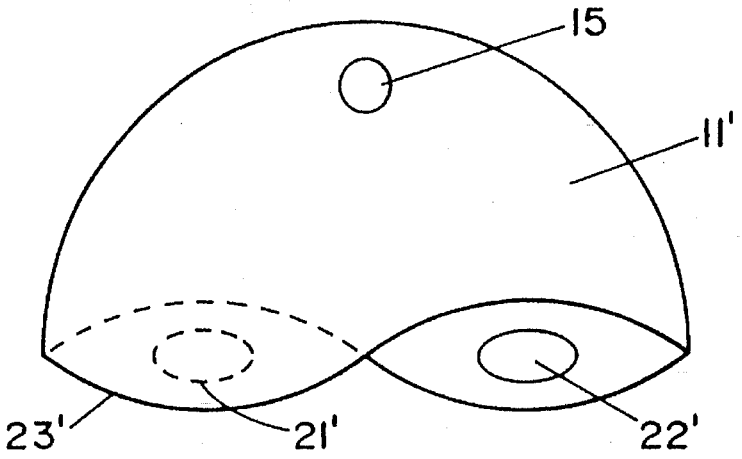
FIGS. 56 and 57 correspond to the two key ring supporting members of the embodiment of FIGS. 18 and 19, but shown on opposite sides of a key ring supporting member in FIG. 58 which can be attached between and to each of the members of FIGS. 56 and 57.
Figure 58:
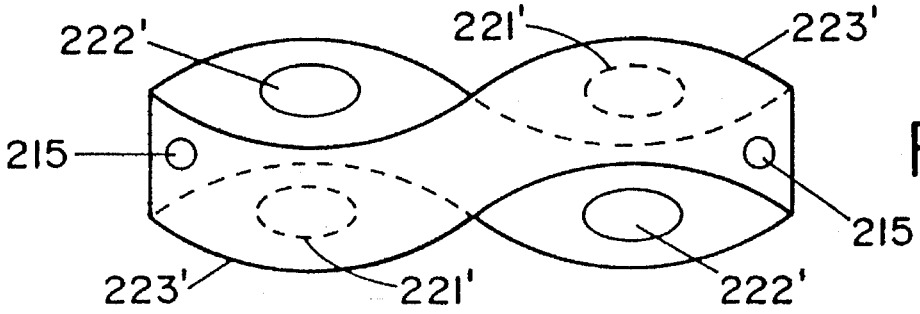
Figure 57:
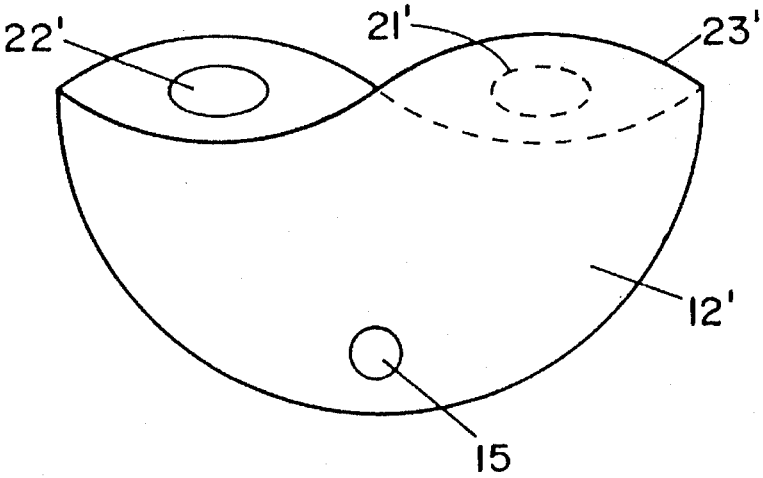

In the embodiment of FIGS. 56–58, FIGS. 56 and 57 correspond identically with the two separated key ring support members of FIG. 19. However, to achieve a key ring support structure having at least three separable key ring support members the support members of FIG. 19 are here shown further separated and with an additional key ring supporting member of FIG. 58 therebetween. The members 11' and 12' are each three-layered structures with mating protuberances 22! on center male layers and recesses 21' on respective outer female layers. The intermediate member of FIG. 58 is a similarly three-layered member but has key ring apertures 215 at its ends and is provided with duplicate sets of protuberances and recesses at its opposite sides for engagement and interconnection respectively with the end support members shown in FIGS. 56 and 57 by pressing the members of FIGS. 56–58 together. Additional members with the same orientation and configuration as that of FIG. 58 can be added in a serial array between:the members of FIGS. 56 and 57 and pressed together to engage all the respective mating protuberances and recesses. The exposed flat surfaces of the members of FIGS. 56–58 when engaged are essentially uninterrupted except for the complimentary S-shaped transverse separation lines 23' and 223'. Such large uninterrupted surfaces provide desirable areas for advertising indicia or the like.

Figure 59:
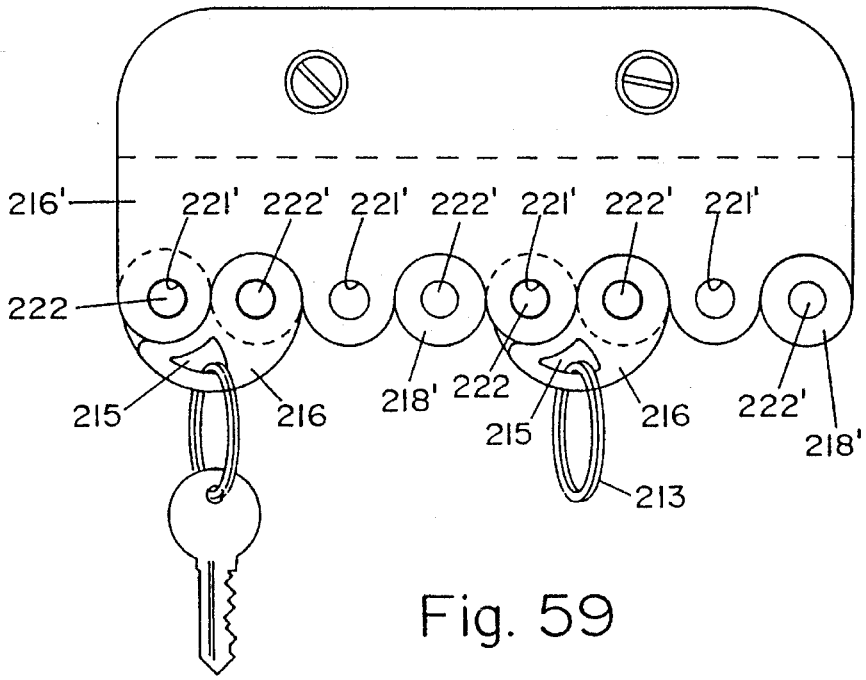
FIGS. 59 and 60 illustrate front and end views of a wall mounted carrier for four key ring supporting members with two such members shown in FIG. 59 attached along a linear row of attachment locations.
Figure 60:
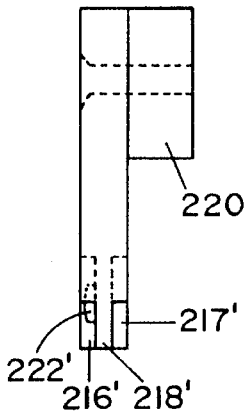

FIGS. 59 and 60 illustrate a support or carrier structure for several key ring support members. In this embodiment a three-layered composite carrier structure is secured to a wall or other like object by means of screws penetrating the layers and a spacing block behind the carrier and above the dotted line in FIG. 59. The carrier has an exposed primary surface stratum layer 216', an intermediate stratum layer 218' and a rear stratum layer 217' with the spacing block behind layer 217'. The carrier of FIGS. 59–60 provides a horizontal row of depending alternating female and male connecting points for engagement with separated key ring support members of FIGS. 48–55. The outer layer 216' has a series of equally spaced recesses 221' alternating with equally spaced protuberances 222' on the middle layer 218'. The rear layer 217' has the same perimetral configuration as the front layer 216' and layers 216' and 217' form therebetween several female mating parts at the locations of the recesses 221' for receiving the male blades carrying protuberances 222 to be retained in the carrier recesses 221'.

Figure 61:
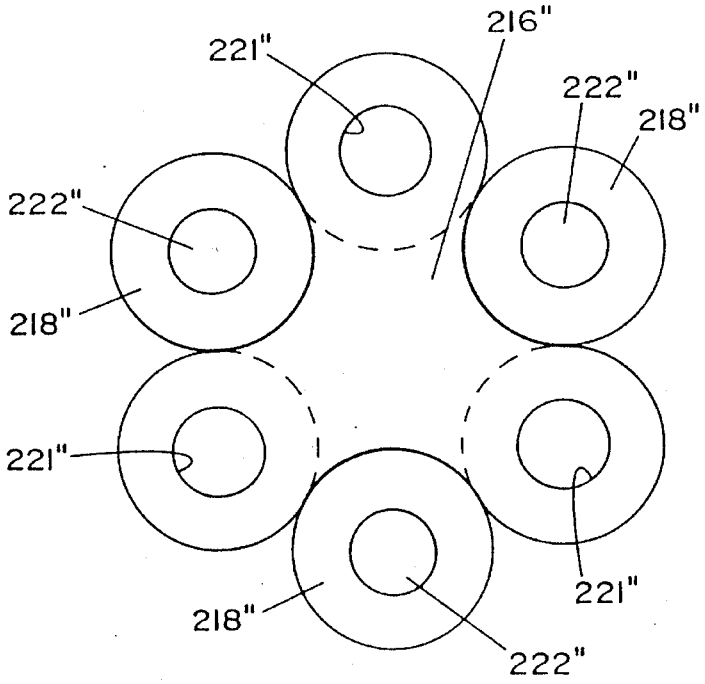
FIGS. 61 and 62 illustrate front and side views of a portable or pocketable carrier for attachment of three key ring supporting members (not shown), such members being attachable along a curved or circular ring of attachment locations.
Figure 62:
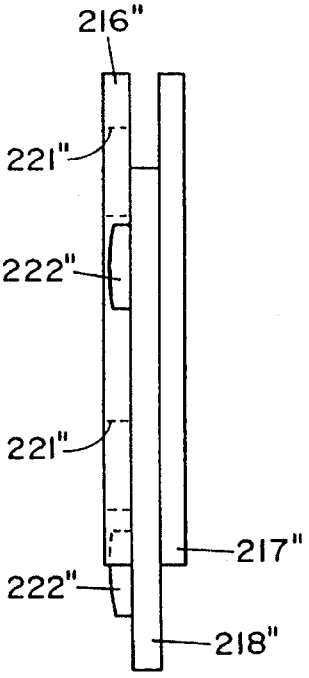

FIGS. 61 and 62 illustrate an alternative flat carrier for separately securing around a ring configuration several separated flat key ring support members of FIGS. 48–55. In this embodiment the several female attachment parts with recesses 221" are alternated with male blade attachment parts of an intermediate layer 218" which carries protuberances 222" to enable three of the support members of FIGS. 48–55 to be individually attached to the carrier in an essentially coplanar relationship enabling the composite structure to be conveniently in a garment pocket.

Figure 63:
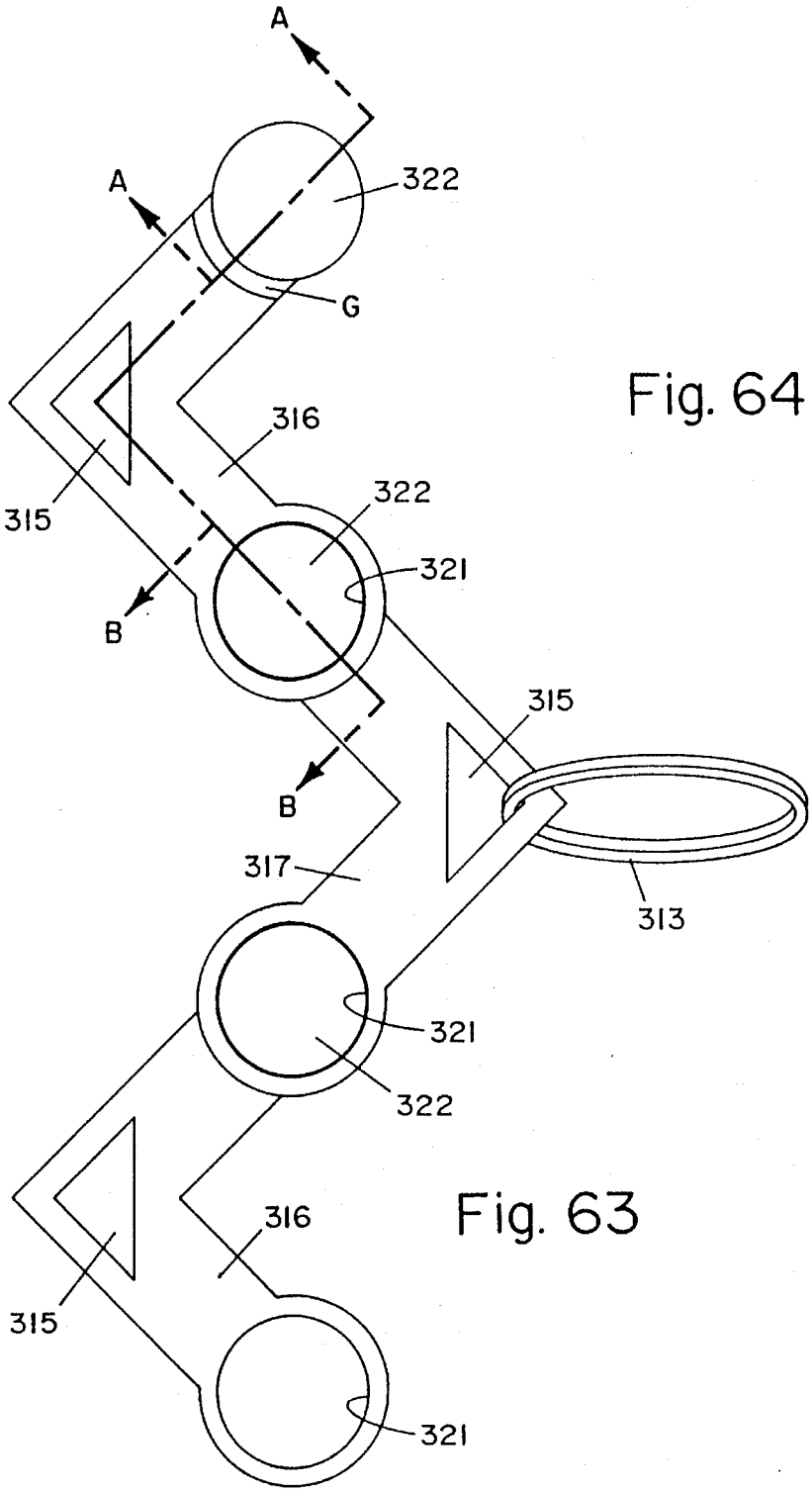
FIGS. 63 through 68 illustrate alternative embodiments of multiple key ring supporting members which can be interconnected in the same manner as the members of FIGS. 43 and 44 to secure two, three, or more such members in a linear or curved loop configuration.

FIGS. 63–68 illustrate four different embodiments of key ring support members which have male attachment parts with protuberances 322 or 422 on opposite sides of the male part. The female attachment parts comprise pairs of narrow rings providing opposed recesses 321 or 421 for receiving and retaining the respective protuberances 322 or 422. In these embodiments the male and female attachment parts are spaced from each other at opposite ends of elongated key supporting members. Key ring apertures 315 or 415 are provided in the respective key ring supporting members. Like the embodiment of FIGS. 43–44, the relative angular pivotable movement enabled by the male and female attaching parts is sufficient for a series of such members to be connected end to end in a line or to have a closed ring of several members connected end to end. FIG. 63 illustrates three identical members connected end to end with the two key ring support members at the ends of this chain having respective front faces 316 exposed, whereas the intermediate key ring support member has its opposite or rear face 317 exposed to illustrate the selective reversibility of the support members. The narrow rings which define the protuberance receiving recesses in the female attachment parts of FIGS. 63–68 fit within grooves G adjacent the protuberances 322 or 422.

Figure 65:
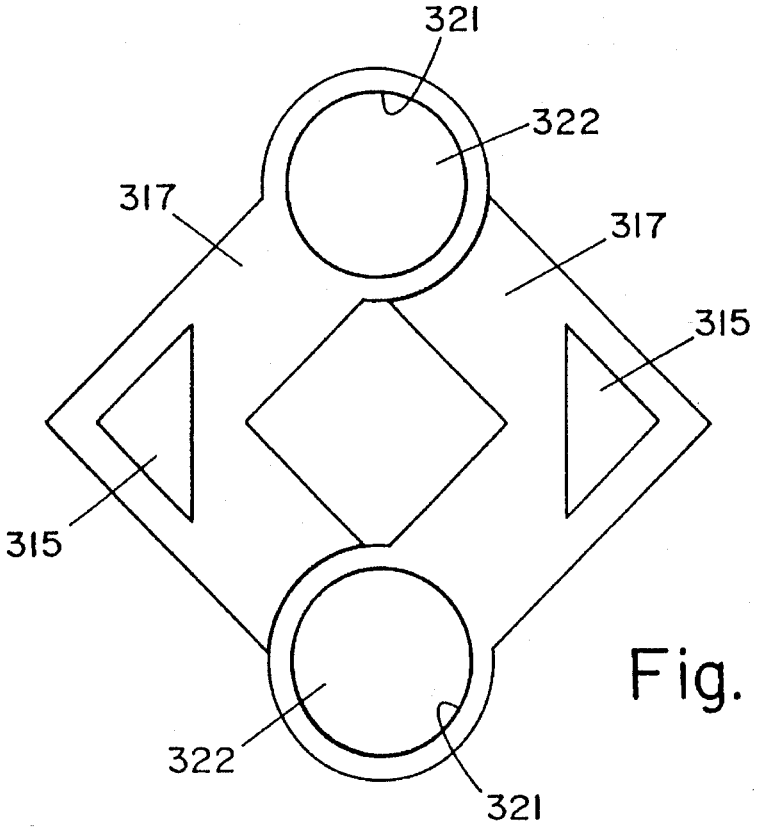

FIG. 65 illustrates how two members of the kind shown in FIG. 63 can be interconnected as a two-member set. Such a set can be opened at one of the male/female connecting end parts and the parts angularly moved relative to the other pivotably connected ends to enable additional members to be inserted and interconnected as part of a closed ring of several members.

Figure 66:
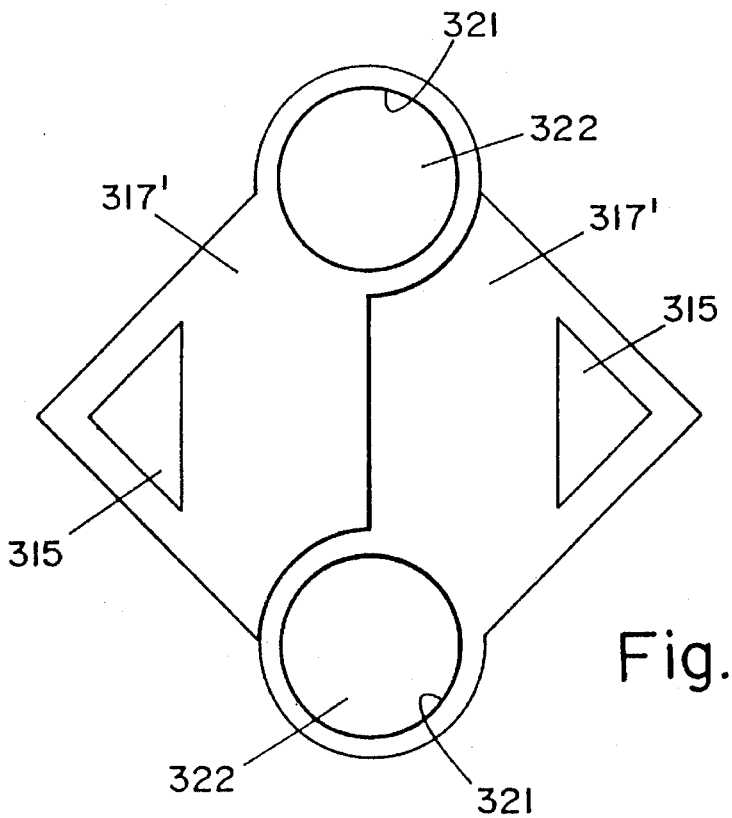

FIG. 66 is an alternative embodiment similar to FIG. 65, but with the respective faces 317 of the two engaged members abutting along a common separating line 323 to provide an uninterrupted surface area for any desired logos or indicia. Additional identical members can be added to the members of FIG. 66 to provide a support structure comprising several support members in a closed loop. Alternatively, and in a manner similar to that disclosed in FIGS. 56–58, one or more generally rectangular intermediate members with key ring apertures at their ends may be provided between and for interconnection with the two members shown in FIG. 66. As in FIG. 58 these intermediate members are to be provided with duplicate sets of attachment parts and protuberances and recesses at opposite sides of the additional members for engagement and interconnection respectively with the members shown in FIG. 66 by pressing such members together. The edges of such intermediate members would be shaped to compliment the shape of the edges defining the separation line 323 of FIG. 66.

Figure 67:
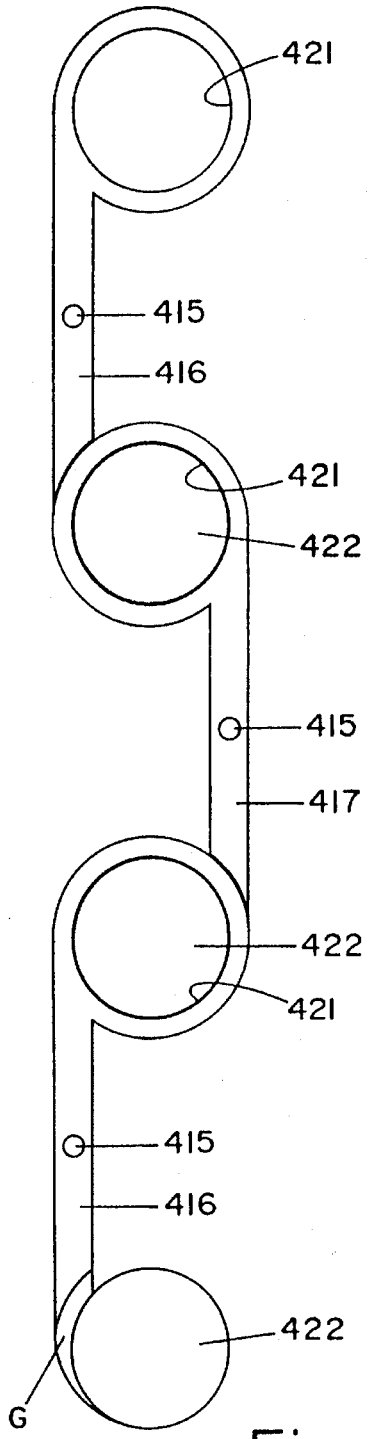
Figure 68:
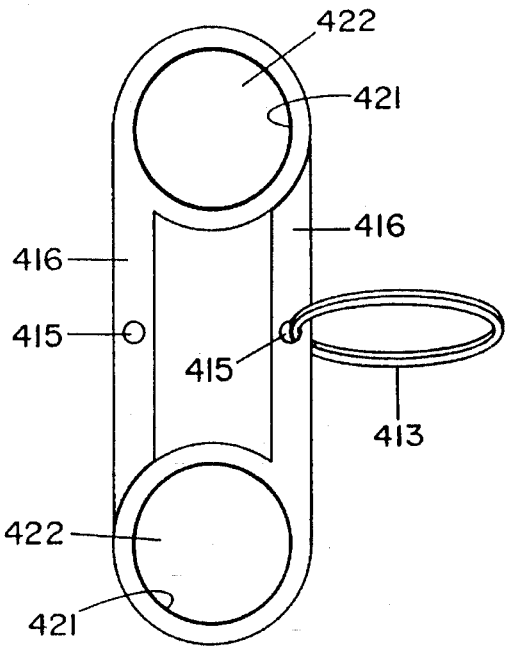

The embodiment of FIGS. 67 and 68 not only has the male and female attachment parts substantially spaced from each other at opposite ends of the key ring support members, but also the portions of the members which interconnect the attachment parts are narrow and at one side of the members whereby a large open area can be provided within a closed loop of such members connected end to end. In lieu of connecting the male and female attachment parts by straight body portions as in FIGS. 67–68 or by L-shaped body portions as in FIGS. 63–65, the interconnecting body portions of the members may be curved or of other shapes.

Figure 64:
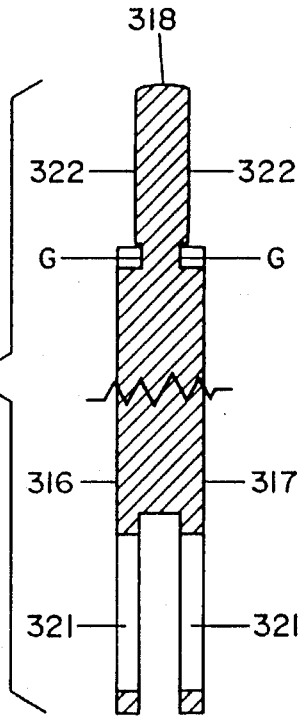

In each of the embodiments of FIGS. 63–68 the relative arrangement of the protuberances 322 or 422 and the female attachment part recesses 321 or 421 has essentially the same section configuration as seen in FIG. 64 although the body portions of the support members between their attachment parts are of different shapes. The body portions typically would have three layers or strata as suggested by other embodiments of the invention.

In the illustrated embodiments the female recesses and the male protuberances of engaged key ring supporting members may be slightly rounded or beveled to facilitate manual engagement or separation. However these engaged parts are resiliently biased toward each other to hold the protuberances in the recesses until forced apart by manually pulling or forcing the members apart. Such biasing may be achieved by shaping the portions of the members forming such recesses or protuberances to enable the inherent elasticity of the material thereof to provide such biasing. The protuberances as at 322 in FIG. 64 or at 222 in FIG. 53 may also be made as resilient inserts or may be resilient shell-like members or have external surfaces supported or biased by internal resilient cushions or springs to bias the external surfaces of the protuberances outwardly into engagement with respective structures of the mating recesses.

Although the preferred method of securing together multiple layers or strata of each individual separable component of the key holder is to mold the parts together, the layers may be united by heat fusion, high frequency heating, sonic fusion, adhesion or physically clamping according to well known processes for use with plastic materials. Pins as shown and described in connection with FIGS. 20–22 may be similarly used, either by themselves or initially attached to one or more of the layers, to secure together various strata or layers in other embodiments.

Other variations within the scope of this invention will be apparent from the described embodiment and it is intended that the present descriptions be illustrative of the inventive features encompassed by the appended claims.

What is claimed is:

1. A support structure for a plurality of key rings comprising a group of at least three interconnected support members, each of at least two of the support members having means for attaching thereto a respective key ring, each of said members having two attachment parts at two separate locations which are directly connectable to other members at said two separate attachment locations by means of manually separable interlocking of respective attachment parts on the respective members at each of said locations, one of said support members of said group being manually separable from said group with the remainder of the support members of said group being interconnectable by said interlocking attachment parts, and wherein two of said members are manually separable from said group of at least three interconnected support members whereby said two members may be interconnected to each other by interlocking attachment parts at two separate attachment locations on each of the respective two members.

2. A support structure for a plurality of key rings according to claim 1 wherein two support members having means for attaching key rings thereto are separable from the support structure and are mutually interconnectable as a separate structure by interconnection of both interlocking attachment parts of one of the two separable support members with respective interlocking attachment parts of the other of the two separable support members.

3. A support structure for a plurality of key rings according to claim 1 wherein each of said support members which has means for attaching a key ring thereto is a relatively flat thin member having exposed opposite faces and which will lie flat within a garment pocket.

4. A support structure for a plurality of key rings according to claim 3 wherein each of said support members which has means for attaching a key ring thereto has attachment pats comprising a round male part with a protuberance and a round female part with a protuberance receiving recess therein.

5. A support structure for a plurality of key rings according to claim 4 wherein said round male and female parts when mated permit a set of two support members interconnected by one pair of such mating attachment parts to have relative angular movement such that the other attachment parts of said set of two support members are completely separated from each other to permit insertion and connection of another such support member therebetween.

6. A support structure for a plurality of key rings according to claim 1 wherein one of said support members is a carrier member having means for attaching the carrier member to another object for supporting the key ring support structure.

7. A support structure for a plurality of key rings according to claim 1 wherein each of members having means for attaching a key ring thereto is an elongated member with the attachment parts thereof separated from each other by an intermediate portion of said member and said means for attaching a key ring to said member is located at said intermediate portion.

8. A support structure for a plurality of key rings comprising a group of at least three interconnected support members, each of at least two of the members having means for attaching thereto a respective key ring, each of said members having two separate attachment parts at different locations on said member by means of which each said member may have its attachment parts directly connected to one or more members of said group by manually separable interlocking attachment means formed by portions of connected attachment parts of the respective members at each of said locations, at least one of said support members of said group being manually separable from said group with the remaining of the support members of said group, if more than one member, being interconnectable by interlocking attachment parts on respective remaining support members.

9. A support structure for a plurality of key rings according to claim 8 wherein, in a set of at least three support members interconnected end to end and forming a loop, such support members are flat with exposed opposite faces and one of the members can have its opposite exposed faces selectively reversed relative to the faces of the other such support members.

10. A support structure for a plurality of key rings according to claim 8 wherein each of the interconnected support members have attachment parts comprising a round male part with a protuberance and a round female part with a protuberance receiving recess therein and also having principal exposed opposite faces of curved teardrop shapes.

11. A support structure for a plurality of key rings according to claim 10 wherein, in a set of four support members interconnected end to end, the centers of the female attachment parts are at the centers of the large ends of said curved teardrop shapes and the curved teardrop shapes have concave curved edges with centers of curvature essentially at the centers of the male attachment parts and wrapping about 90 degrees around the large ends of the teardrop shapes.

12. A support structure for a plurality of key rings comprising a group of at least two interconnected support members, each of the support members having means for attaching thereto a respective key ring, each of said support members having two separate attachment parts at different locations thereon by means of which each said member may have its attachment parts directly connected to one or more members of said group by manually separable interlocking mating means formed by connected attachment parts of the respective members at each of said locations, said support members being relatively movable and having their attachment parts so configured to permit at least one additional such support member to be interconnected by its attachment parts as a further component of the support structure.

13. A support structure for a plurality of key rings according to claim 12 wherein said interlocking mating means comprises interfering surfaces at the inside of a female structure and at the outside of a male structure which mates with such a female structure.

14. A support structure for a plurality of key rings according to claim 13 wherein at least one of the interfering surfaces is resiliently yieldable.

15. A support structure for a plurality of key rings according to claim 14 wherein the resiliently yieldable surface is part of a protuberance on the male structure.

16. A support structure for a plurality of key rings according to claim 13 wherein said interfering surfaces provide for pivoted movement of said male structure relative to the female structure through an angle of at least 60 degrees to enable three members to be connected end to end in a loop.

17. A support structure for a plurality of key rings according to claim 16 wherein said angle is at least 180–360/n degrees for connecting n members end to end in a loop and n is at least 3.

18. A support structure for a plurality of key rings according to claim 12 wherein at least three of said members are connected to form an array having two support members at opposite ends thereof with each such end member having two such interlocking mating parts, at least one additional supporting member being connected between said end members.

19. A support structure for a plurality of key rings according to claim 18 wherein each such additional member two sets of interlocking mating parts at opposite sides thereof for connection to interlocking mating parts on the end support members or on other such additional supporting members.

20. A support structure for a plurality of key rings according to claim 19 wherein said support members together present on each of opposite faces of the structure a large continuous surface between rows of said mating parts with each surface having transverse separation lines between adjacent connected members.

21. A support structure for a plurality of key rings according to claim 6 wherein said carrier member has means for hanging said key ring support structure from part of a garment.

22. A support structure for a plurality of key rings according to claim 6 wherein said carrier member has means for anchoring it to a wall.

23. A support structure for a plurality of key rings according to claim 19 wherein the location of the means for attaching a key ring to a member is at a side of the member and essentially longitudinally intermediate the attachment parts of the respective member.

24. A support structure for a plurality of key rings according to claim 19 wherein at least one of said support members of said group is manually separable from said group with the remainder of the support members of said group, if more than one remaining member, being interconnectable by said interlocking mating parts.

25. A support structure for a plurality of key rings according to claim 19 wherein one attachment part for each member comprises a pair of spaced plates defining a female gap therebetween and the other attachment part for such member comprises a male blade moveable into the female gap of another member.

* * * * *